US005241323A

United States Patent [19]

Kelly

[11] Patent Number: 5,241,323

[45] Date of Patent: Aug. 31, 1993

[54] SHAPED BEAMS FROM UNIFORMLY ILLUMINATED AND PHASED ARRAY ANTENNAS

[75] Inventor: Kenneth C. Kelly, Sherman Oaks, Calif.

[73] Assignee: Hughes Aircraft Company, Los Angeles, Calif.

[21] Appl. No.: 627,083

[22] Filed: Dec. 13, 1990

[51] Int. Cl.[5] ..... H01Q 19/06; H01Q 21/00; H01Q 13/10

[52] U.S. Cl. ..... 343/754; 343/853; 343/700 R; 343/768; 343/771

[58] Field of Search ..... 343/754, 853, 700 MS, 343/768, 771

[56] References Cited

U.S. PATENT DOCUMENTS 3,774,222 11/1973 Charlton ..... 343/771

4,792,808 12/1988 Hildebrand ..... 343/853

4,814,779 3/1989 Levine ..... 343/754

4,899,162 2/1990 Bayetto et al. ..... 343/700 MS

*Primary Examiner*—Rolf Hille

*Assistant Examiner*—Wael Fahmy

*Attorney, Agent, or Firm*—L. A. Alkov; W. K. Denson-Low

[57] ABSTRACT

A constant gain sector beam array is obtained by applying equal amplitude, equal phase excitations to a sector array characterized by a curved array geometry. In a simple form, the curve is the arc of a portion of a circle. The radiation pattern can be further enhanced by using a more complex curvature geometry, and by minor adjustments to the amplitudes in the slots. Other forms of shaped beams, such as a cosecant squared antenna pattern, may be obtained by appropriately shaping the curvature geometry.

3 Claims, 5 Drawing Sheets

FIG. 1
(PRIOR ART)
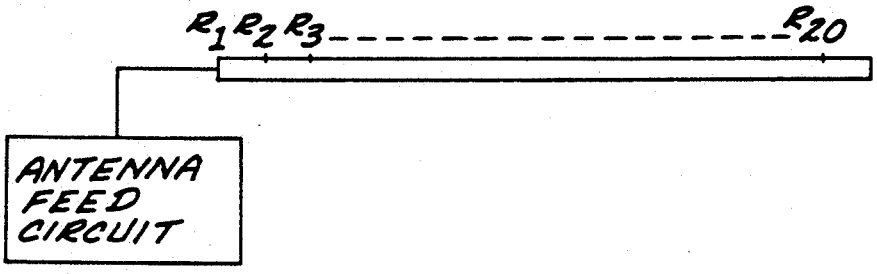
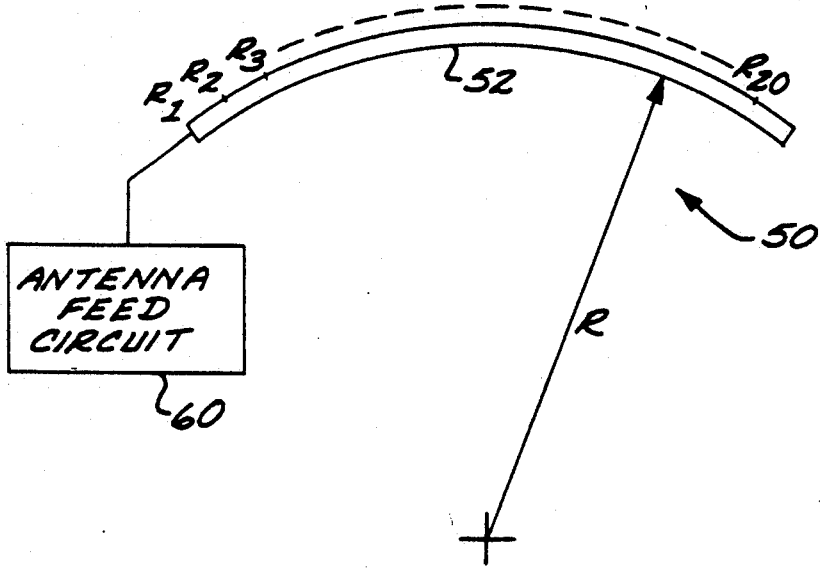
FIG. 3

SHAPED BEAMS FROM UNIFORMLY ILLUMINATED AND PHASED ARRAY ANTENNAS

BACKGROUND OF THE INVENTION

The present invention relates to array antennas, and more particularly to an array employing equal amplitude and phase excitations of the radiating elements.

It is well known that array antennas of closely spaced radiating elements will produce a constant gain sector beam on a polar radiation pattern plot, or a flat topped beam on a rectangular radiation pattern plot. In the conventional design, all of the radiators lie in a plane which is essentially perpendicular to the direction of the flat topped beam. The radiating elements must be excited according to values of the function (sin(x))/x where x is in radians. That function changes its magnitude values rapidly, and also undergoes abrupt phase changes of 3.1416 radians. Because of mutual coupling between radiating elements, it is difficult to obtain an array whose elements conform to the desired (sin(x))/x function, especially when the desired sector beam is to cover a large angular region.

Sector beams are used, for example, to give uniform power density over the 3° to 4° sectoral extent of a nation as seen from a geostationary satellite. In terrestrial communication and broadcasting systems it is often desired to uniformly illuminate just one community which may be entirely within a, say, 80° sector as seen from the system's site. Complex power dividers and various lengths of transmission line have been used in the past to achieve the needed sin(x)/x excitations. But, mutual coupling between elements of the array forces a number of trial and error iterations before the desired pattern is obtained. Using the principle of this invention, easy-to-design uniform power dividers and equal length transmission lines to the radiating elements lower the design and fabrication costs. Shaped beams other than constant gain sector beams can be obtained by locating the radiating elements along paths other than the arc of a circle. Where the sector is to be a large angle, such as 120° or more, antennas embodying the invention will work, whereas the conventional sin(x)/x synthesis from a planar aperture will not.

SUMMARY OF THE INVENTION

The purpose of this invention is to eliminate the struggle to fit the radiating element excitation magnitudes and phase to the sin(x)/x demands and other problematic excitation functions used to attain shaped beams. Instead, easier-to-achieve equal amplitude, equal phase excitations are used. In accordance within the invention, the array is curved in order to obtain the case of a sector beam. In its simplest embodiment, the curve is in the form of an arc of a circle. The radiation pattern shape can be further enhanced by using curves which are more complex than simply the arc of a circle, or by minor adjustments to the field amplitudes at the radiators. In the latter instance, simple changes from the equal amplitude case while maintaining equal phase can enhance pattern shape in some instances.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is a simplified schematic diagram illustrative of the geometry of a conventional sector beam antenna.

FIG. 3 is a simplified schematic diagram of a sector beam antenna embodying the invention.

DESCRIPTION OF THE PREFERRED EMBODIMENT

Figure 2:
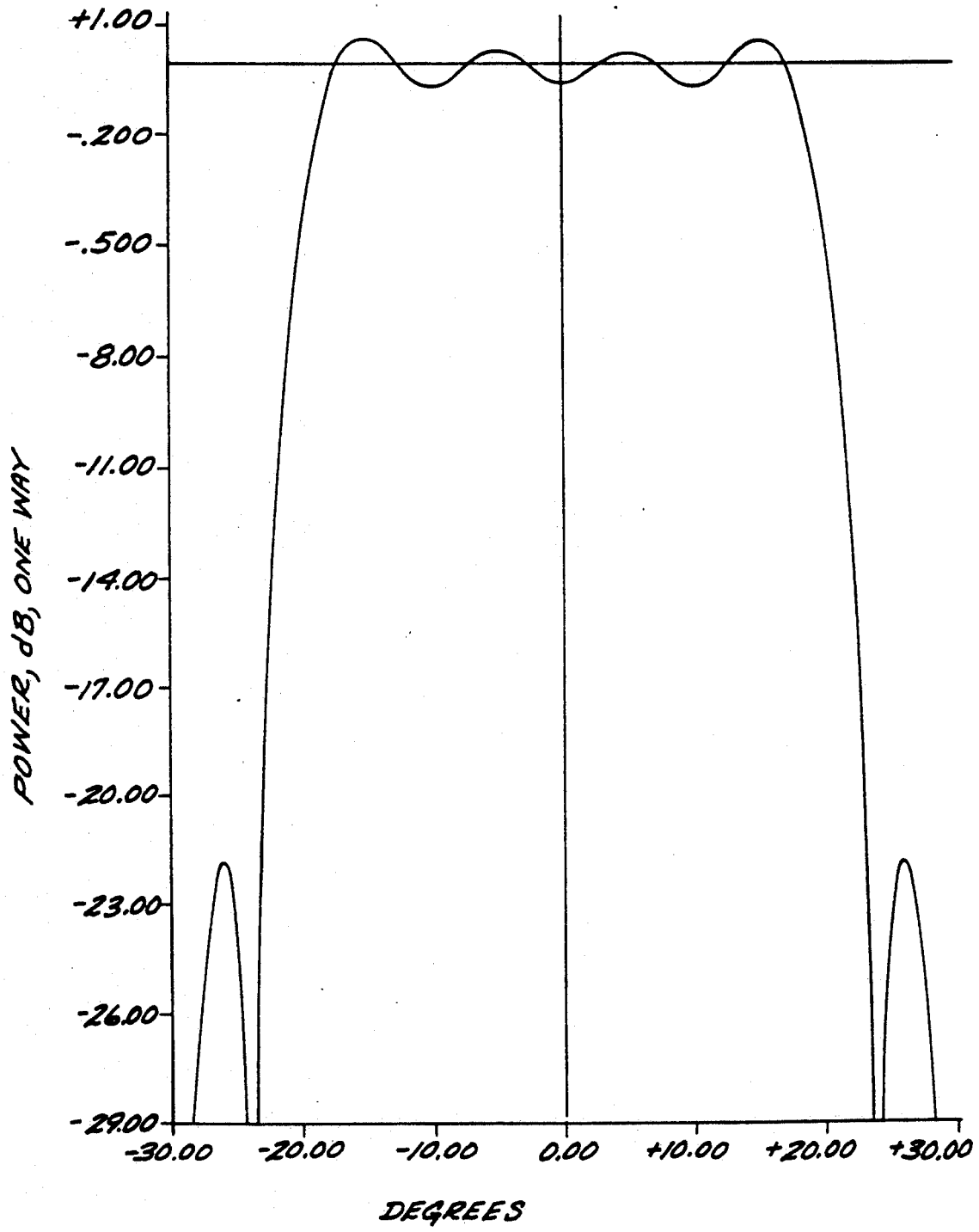
FIG. 2 is a diagram of the radiation pattern of the conventional array of FIG. 1.

The invention will be described by first noting the geometry of the conventional approach, as well as the resulting radiation pattern. The same will then be done for a design based on this invention. FIG. 1 illustrates the geometry of a conventionally designed sector beam antenna, where all of the radiators lie in a plane which is essentially perpendicular to the direction of the flat-topped beam. Table I sets forth a table of the excitation coefficients for the antenna of FIG. 1. FIG. 2 illustrates the resulting radiation pattern for the sector beam antenna of FIG. 1 excited in accordance with Table I.

TABLE I

| Array Element # | Voltage Amplitude | Phase |
|---|---|---|
| 1 and 20 | 0.06 | 0 radians |
| 2 and 19 | 0.06 | 0 |
| 3 and 18 | 0.08 | $\pi$ |
| 4 and 17 | 0.07 | $\pi$ |
| 5 and 16 | 0.10 | 0 |
| 6 and 15 | 0.11 | 0 |
| 7 and 14 | 0.14 | $\pi$ |
| 8 and 13 | 0.20 | $\pi$ |
| 9 and 12 | 0.34 | 0 |
| 10 and 11 | 1.00 | 0 |

FIG. 3 illustrates an antenna designed according to this invention. In this exemplary embodiment, the antenna 50 comprises a waveguide which defines a circular arc of radius R. The radiating elements $R_1$–$R_{20}$ of antenna 20 comprise radiating slots formed in the convex side of the curved waveguide. It will be apparent that the physical antenna of FIG. 3 is similar to that of FIG. 1, except for the curvature of the element 52. However, whereas the radiating elements of conventional antenna of FIG. 1 must be excited by the (sin x)/x distribution to achieve a constant gain sector antenna, the radiating elements of antenna 50 of FIG. 3 are excited by in-phase and equal amplitude signals provided by spacing the slot radiators one-half waveguide wavelength apart and using alternating offsets or inclinations slot radiators in a manner well known to those familiar with slotted waveguide arrays.

Figure 4:
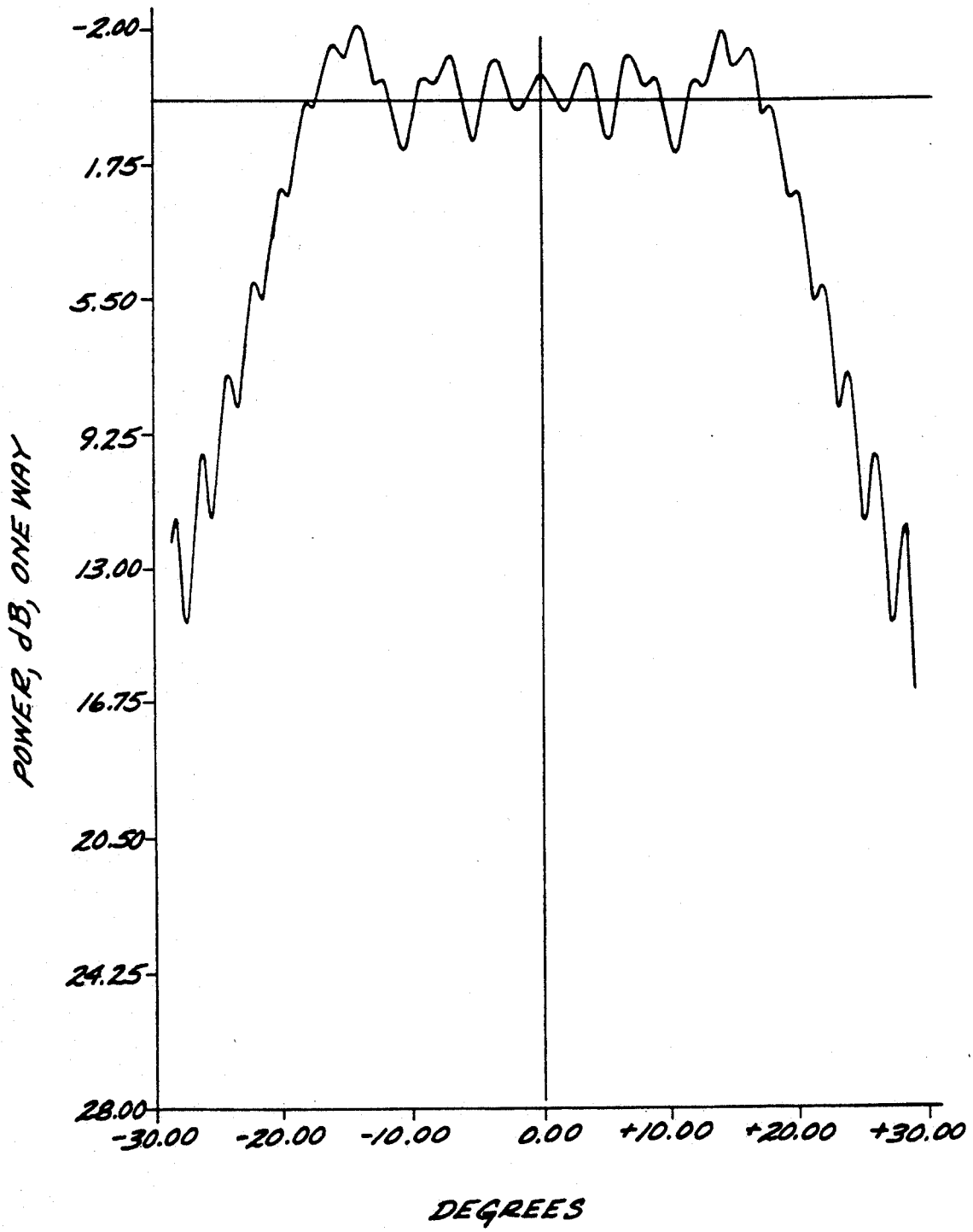
FIG. 4 is a diagram of the radiation pattern of the novel array configuration of FIG. 3.

Table II sets forth the excitation coefficients for the antenna of FIG. 3. FIG. 4 illustrates the resulting radiation pattern for the sector beam antenna of FIG. 3, excited in accordance with Table II.

TABLE II

| Array Element | Voltage Amplitude | Phase |
|---|---|---|
| All | 1.0 | 0 radians |

Instead of slot radiators spaced along a single waveguide, a central power divider and the use of equal-path-length lines feeding of the antenna elements allows broadband operation, since the radiating elements remain in-phase regardless of the frequency. This type of antenna feed circuit is typically referred to as a corporate feed.

Sector beams of narrow widths, or of extremely wide widths are achieved with equal ease, using this invention. Analysis has shown that there is a radius of curvature and a number of radiators which will achieve any desired sector width. A computer program has been developed to plot the sector beam radiation pattern obtained by a circularly curved antenna embodying the present invention. The program is listed in Table III. The program receives as user input the total angle over which constant gain is desired, the arc length between radiating elements, the design frequency, the circle radius and the angle over which the computer radiation pattern is to be plotted. The program outputs a plot of the resulting radiation. The program can be used to design a curved antenna having a desired radiation pattern, since it predicts the pattern of antenna with defined parameters. By plotting the patterns of various antennas having different parameters, one can determine the parameters of an antenna having a desired radiation pattern.

TABLE III

```
10   REM:  THIS IS A "BASIC" LANGUAGE PROGRAM
100  REM:  THIS PROGRAM COMPUTES THE
           PATTERN OF SECTOR BEAM PRODUCED
110  REM:  BY AN ARRAY OF POINT SOURCES
           AROUND A PORTION OF A CYLINDER
120  REM:  OF RADIOUS "0". THE POINT SOURCES
           ARE EQUALLY SPACED AND LIE
130  REM:  IN A PLANE PERPENDICULAR TO THE
           CYLINDER AXIS, AND THE PATTERN
140  REM:  COMPUTED BY THIS PROGRAM IS THE
           PATTERN IN THAT PLANE
150  REM:  THIS PROGRAM IS ALSO APPLICABLE
           POINT SOURCES ARE EXPANDED TO
160  REM:  BE LINE SOURCES PARALLEL TO THE
           CYLINDER AXIS AND PASSING
170  REM:  THE POINT SOURCE LOCATIONS
180  REM:  THE VARIABLE USED ARE AS FOLLOWS
190  REM:  A1=TOTAL ANGLE OVER WHICH THE
           PATTERN WILL BE PLOTTED
200  REM:  S1=TOTAL ANGLE OF THE DESIRED
           CONSTANT GAIN SECTOR
210  REM:  D=ARC LENGTH BETWEEN POINT
           SOURCES, IN FREE SPACE
           WAVELENGTHS
220  REM:  0=CYLINDER RADIUS IN INCHES
230  REM:  F=MICROWAVE FREQUENCY IN GHZ
240  REM:  W=FREE SPACE WAVELENGTH AT F
           GHZ, IN INCHES
250  REM:
260  REM:  C=CONVERSION FACTOR, DEGREES
           TO RADIANS
270  REM:  A=A1 EXPRESSED IN RADIANS
280  REM:  T=ANGULAR SPACING BETWEEN POINT
           SOURCES, IN RADIANS
290  REM:  S=NUMBER OF POINT SOURCE SPACING
           ANGLES WITHIN A1
300  REM:  Q1=HALF THE NUMBER OF POINT
           SOURCES EMPLOYED
304  DIM   P(3421.4)
310  C=57.29578
320  A1=5
330  S1=4
```

TABLE III-continued

```
340  D=.7071
350  O=393
360  F=12.45
370  W=11.80285/F
380  E=D*W
400  A=A1/C
410  T=E/O
420  S=A/T
430  S2=INT(S1/(C*T))+1
440  IF S2/2>INT(S2/2) THEN 450 ELSE 460
450  S2=S2-1
460  Q1=S2/2
470  Q2=INT(1.570798/T+.5)
480  LPRINT "SLOT SPACINT="360*D"DEGREES IN
     FREE SPACE."
485  REM:  PROGRAM LINES 490 TO 630 ARE USED TO
           SET UP THE PLOTTING
485  REM:  PROGRAM TO PLOT THE OUTPUT OF
           THIS COMPUTATION. WITH
487  REM:  VARIOUS MACHINES THESE LINES MUST
           FIT YOUR PLOTTER
490  FILE #1="TAPE2"
500  RESTORE #1
510  FILE #2="FPLIST"
520  RESTORE #2
530  PRINT #2, " $FPLIST PATF=1,"
540  PRINT #2," NORFF=0,"
550  PRINT #2," VLEN=9, VMAXL=2"
560  PRINT #2," VMINL=-28,VDIVL=9,"
570  PRINT #2," HLEN=6.5,HDIVL=7,"
580  PRINT #2," HMINL="=A1/2",HMAXL="A1/2","
590  PRINT #2," SC(1,1)=.2,1,.12,2,2,2"
600  PRINT #2," SA(1)=""2*q1"SLOTS"D"WVLNGTH
     SPCD ON"O"IN. RADIUS',"
610  PRINT #2," SC(1,2Z0.2,.7,.12,2,2,2,"
620  PRINT #2," SA((12)='="O/W"WVLNGTH RADIUS.
     SOURCES COVER" (2*Q1-1)*T*C"DEG.',"
630  PRINT #2," $,"
650  G=.532345*F
660  U=INT(S/2)
670  IF U/2>INT(U/2) THEN 680 ELSE 690
680  U=U-1
682  REM:  LINES 690 THROUGH 730 ESTABLISH THE
           PATH LENGTH FROM EACH
684  REM:  ELEMENT TO A PLANE PERPENDICULAR
           TO THE RADIUS OF THE CIRCLE
686  REM:  OF RADIUS O. THESE LINES WOULD
           HAVE TO BE DIFFERENT IF A SHAPE
688  REM:  OTHER THAN A CIRCLE IS USED TO
           ACHIEVE SOME OTHER PATTERN THAN
689  REM:  A SECTOR BEAM
690  FOR B=0 TO 4
700  FOR N=1 TO 2*Q2
710  P(N,B)=-(1-COS(1.57096-T*(N-1.1+.2*B)))*O*G
720  NEXT N
730  NEXT B
740  IF Q2-Q1<0 THEN 760
750  GO TO 770
760  Q1=Q2
762  REM:  LINES 770 THROUGH 810 HAVE THE SOLE
           FUNCTION OF DETERMINING THE
784  REM:  CONSTANT BY WHICH TO NORMALIZE
           THE PEAK OF THE PATTERN TO A
766  REM:  VALUE OF OR NEAR ZERO dB.
770  FOR N=Q2-Q1 TO Q2+Q1-1
780  R=R+COS(P(N,1))
790  I=I+SIN(P(N,1))
800  NEXT N
810  M=R  2+I  2
820  R=0
830  I=0
832  REM:  LINES 850 THROUGH 970 PERFORM THE
           THEORETICAL RADIATION PATTERN
834  REM:  CALCULATION OVER THE ANGULAR
           REGION -A1/2 TOA1/2 DEGREES
850  FOR H=-U+1 TO U
860  FOR B=0 TO 4
870  FOR N=1 TO 2*Q1
880  Y=H-N+Q1+Q2+1
890  R=R+COS(P(Y,B)
900  I=I+SIN(P(Y,B))
910  NEXT N
```

TABLE III-continued

```
920   C1=R  2+I  2
930   C2=4.343*LOG(C1/M)
950   A2=(H-.7+.2*B)*T*C
955   REM:  LINE 970 PUTS THE DATA INTO A
            PLOTTING FILE FOR THE PARTICULAR
956   REM:  PLOTTING PROGRAM, "FASTPLOT",
            BEING USED. OTHER USER WOULD HAVE
957   REM:  TO USE A FORM OF LINE 970 TO SUIT
            THE PLOT PROGRAM THEY WISH.
970   PRINT #1 USING "#####.##",0;A2;C2
980   I=0
990   R=0
1000  NEXT B
1010  NEXT H
1020  END
```

For achieving other beam shapes, such as the widely used cosecant squared antenna beam shape for mapping radar systems, a different computer program would have to be used. The position line of the radiating elements can become a combination of concave and convex curvatures of differing radii.

Figure 5:
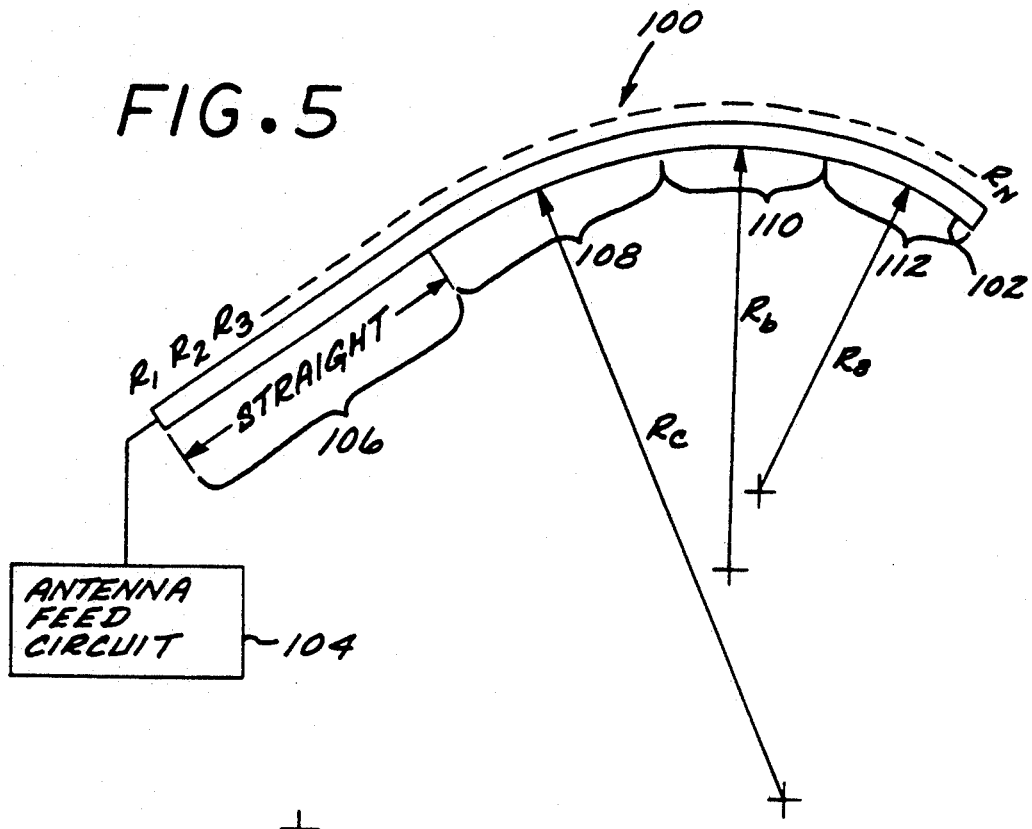
FIG. 5 is a simplified schematic diagram of an antenna array in accordance with the invention which may be used to generate a beam having a cosecant squared shape.

FIG. 5 illustrates in simplified form an antenna embodying the invention wherein the curvature of the antenna structure 102 defining the radiating elements $R_1$-$R_n$ is not a simple arc of a circle. Once again, the antenna feed circuit 104 feeds the respective radiating elements with equal amplitude, equal phase electromagnetic energy in accordance with the invention. The structure 102, which may comprise a waveguide in which radiating slots are formed, defines a straight section 106, a first curved section 108 of radius $R_c$, a second curved section 110 of radius $R_b$, and a third curved section 112 of radius $R_a$, where $R_a$ is less than $R_b$, which is in turn less than $R_c$. Such a complex shape of the antenna structure 102 can be used to generate a shaped beam such as a cosecant squared beam shape.

Figure 6:
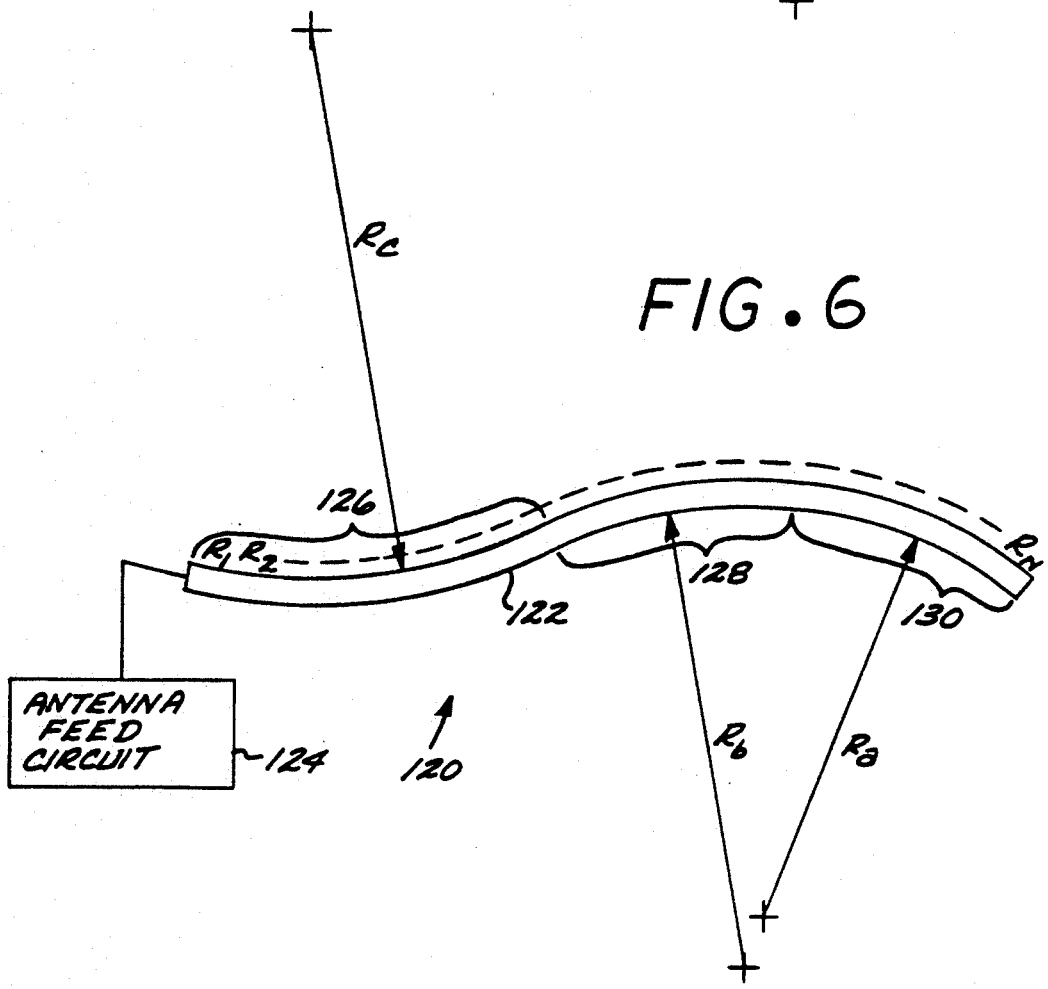
FIGS. 6, 7 and 8 illustrate antenna arrays in accordance with the invention which may be used to produce beams of more complex shapes.

FIG. 6 shows a more complexly shaped antenna 120 comprising antenna structure 122 and antenna feed circuit 124. The feed circuit 124 feeds each radiating element $R_1$-$R_n$ with equal amplitude, equal phase electromagnetic energy. In this embodiment, the structure 122 defines a shape having adjacent convex and concave surfaces. Thus, the structure 122 includes a first section 126 having a convex curvature of radius $R_c$, an intermediate curved section 128 having a radius $R_b$, and a third curved section 130 of radius $R_a$, where $R_a$ and $R_c$ are of opposite sense (convex/concave) and the intermediate curvature $R_b$ is a transition between the two curved sections 126 and 130. The antenna 120 can be used to generate more complex beam shapes.

Figure 7:
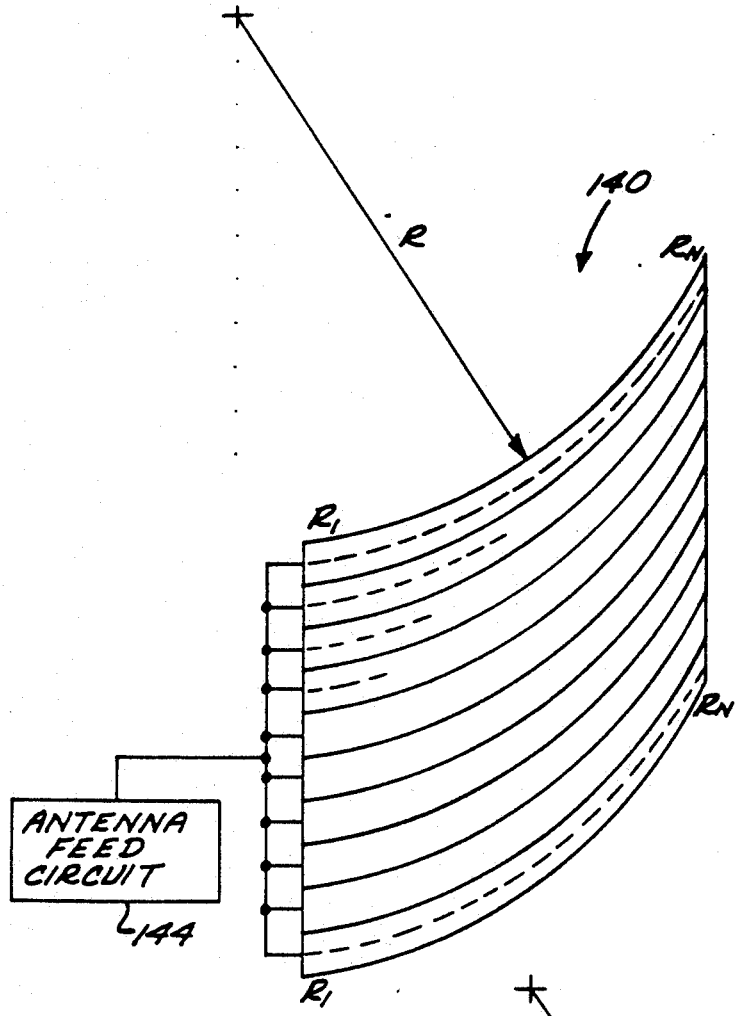

FIG. 7 shows an antenna array 140 which is shaped as a sector of a cylinder, with a linear arrangement of the elements in one direction and a simple curved shape in the orthogonal direction. This antenna structure can be used to generate a shaped beam in one plane and a pencil beam in the orthogonal plane. The array 140 includes an antenna structure 142 which defines the curvature of the antenna, and carries or defines the respective rows of adjacent radiating elements $R_1$-$R_n$. All the radiating elements are fed by the antenna feed circuit 144 with equal amplitude, equal phase electromagnetic energy. The structure 142 is characterized by a curvature of radius R in one sense, and is linear along an orthogonal sense.

Figure 8:
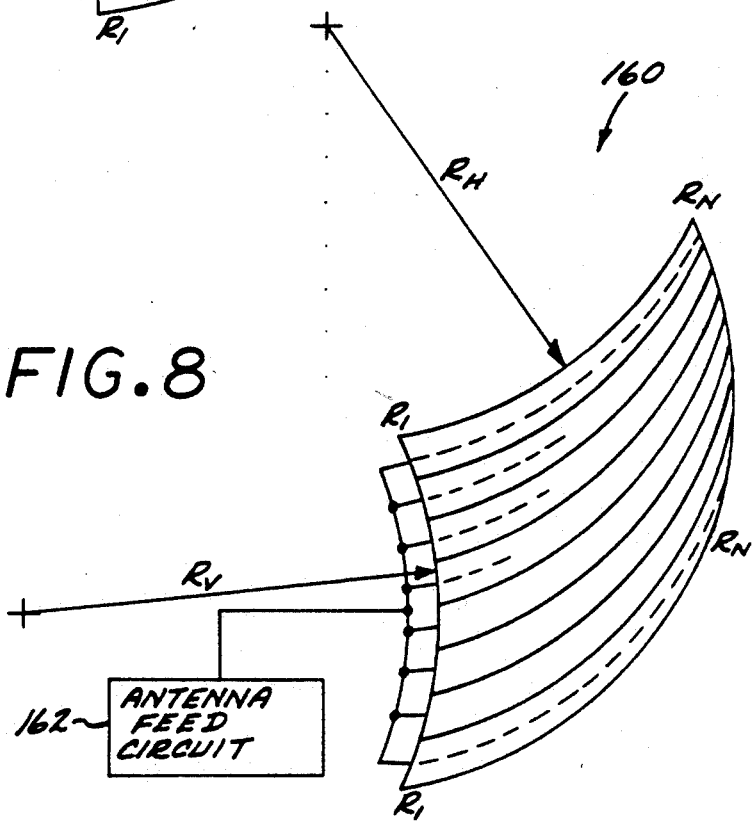

FIG. 8 shows an antenna array 160 which includes a structure 162 carrying or defining an array of radiating elements $R_1$-$R_n$ in respective adjacent rows, and an antenna feed circuit 162. The feed circuit 162 provides all the radiating elements of the array 160 with equal amplitude, equal phase electromagnetic energy. The structure 162 is characterized by a complex curvature such as defined by a surface sector of an ellipse. Thus, the structure 162 defines a surface having a radius of $R_h$ in a horizontal plane, and a radius of $R_v$ in a vertical plane. The antenna 160 can be used to provide a shaped beam oriented in a vertical plane, and also in a horizontal plane, wherein the shaping in the respective planes can be alike or different, dependent on $R_a$ and $R_b$.

It is understood that the above-described embodiments are merely illustrative of the possible specific embodiments which may represent principles of the present invention. Other arrangements may readily be devised in accordance with these principles by those skilled in the art without departing from the scope and spirit of the invention. For example, the radiating elements could be groundplane-backed electric dipoles, helix radiators or polyrod radiators, etc., located along the needed curved path.

What is claimed is:

1. A phased array antenna for producing a cosecant squared shaped beam, comprising:

an array of radiator elements arranged in a predetermined configuration selected to obtain said shaped beam, said configuration comprising a linear array portion and a curved portion, wherein said curved portion comprises first and second curved portions defined by respective circular arcs of different radii;

antenna feed means for exciting said radiator elements by equal amplitude, equal phase electromagnetic signals; and wherein the length of said linear array portion, the curvature of said curved portion and the number of said elements in said configuration are selected to provide said cosecant squared shaped beam.

2. A phased array antenna for producing a shaped beam, comprising:

an array of radiator elements arranged in a predetermined configuration selected to obtain said shaped beam, said configuration comprising a first convexly-curved portion and a second concavely-curved portion; and antenna feed means for exciting said radiator elements by equal amplitude, equal phase electromagnetic signals.

3. A phased array antenna for producing a cosecant squared shaped beam, comprising:

an array of radiator elements arranged in a predetermined configuration selected to obtain said shaped beam, said configuration comprising a linear array portion and a curved portion wherein said curved portion comprises a first curved portion of radius $R_c$, a second curved portion of radius $R_b$, and a third curved portion of radius $R_a$, wherein $R_a$ is less than $R_b$, and $R_b$ is in turn less than $R_c$;

antenna feed means for exciting said radiator elements by equal amplitude, equal phase electromagnetic signals; and wherein the length of said linear array portion, the curvature of said curved portion and the number of said elements in said configuration are selected to provide said cosecant squared shaped beam.

* * * * *